US005326290A

United States Patent [19]

Chailleux et al.

[11] Patent Number: 5,326,290

[45] Date of Patent: Jul. 5, 1994

[54] ELECTRICAL CONNECTOR

[75] Inventors: Bruno Chailleux; Philippe Choquet, both of Le Mans, France

[73] Assignee: Framatome Connectors International, Courbevoie, France

[21] Appl. No.: 945,329

[22] Filed: Sep. 16, 1992

[30] Foreign Application Priority Data

Sep. 26, 1991 [FR] France ..... 91 11844

[51] Int. Cl.[5] ..... H01R 4/48

[52] U.S. Cl. ..... 439/862; 439/660

[58] Field of Search ..... 439/851-857, 439/861, 842, 843, 824, 700, 660, 692, 668, 669, 862

[56] References Cited

U.S. PATENT DOCUMENTS

| | | | |
|---|---|---|---|
| 2,443,509 | 6/1948 | Lundy | 439/851 |
| 2,539,230 | 1/1951 | Craig | 439/849 |
| 3,933,405 | 1/1976 | Patterson, Jr. et al. | 439/289 |
| 4,002,400 | 1/1977 | Evans | 439/851 |
| 4,703,986 | 11/1987 | McCormick | 439/289 |
| 4,900,278 | 2/1990 | Yamada et al. . | |

FOREIGN PATENT DOCUMENTS 0147076 7/1985 European Pat. Off. .

*Primary Examiner*—David L. Pirlot

*Attorney, Agent, or Firm*—Wegner, Cantor, Mueller & Player

[57] ABSTRACT

A connector comprises at least one elastically deformable lamellar flexible electrical contact member and at least one rounded rigid electrical contact member which come into electrical and mechanical contact with each other on relative displacement of the rigid member towards the flexible member in a direction intersecting the general orientation of the flexible member which is thereby tensioned elastically. The free end of the flexible member has a curved area whose concave side faces towards the rigid member and whose radius of curvature is greater than the radius of the cross-section of the rigid member. This curved area is extended by an oppositely curved engagement area.

8 Claims, 3 Drawing Sheets

FIG_6
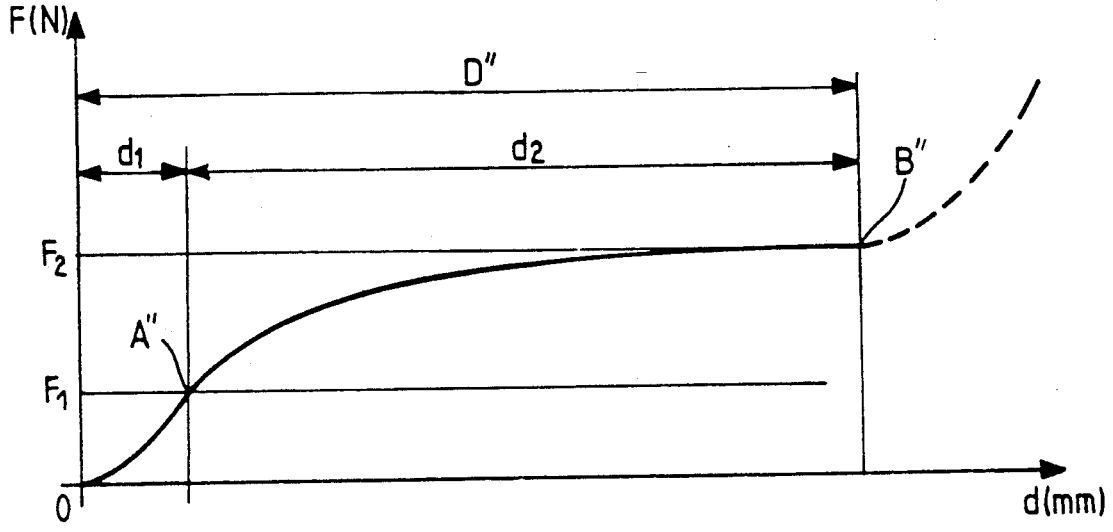
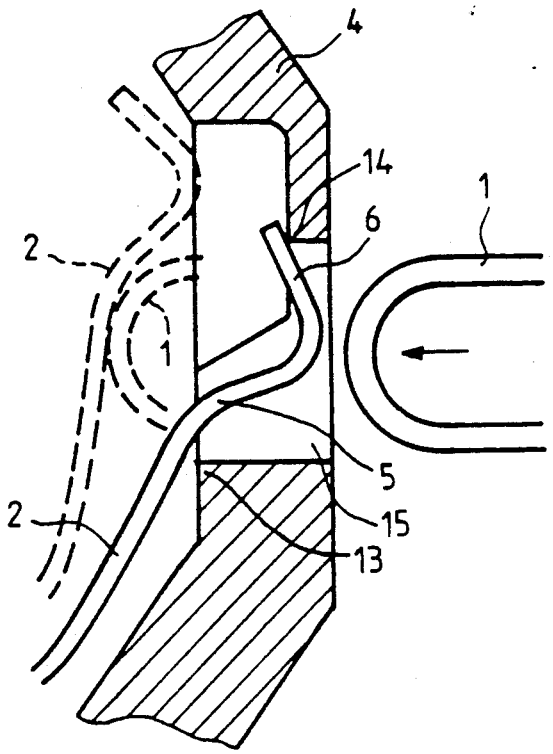
FIG_7

ELECTRICAL CONNECTOR

BACKGROUND OF THE INVENTION

1. Field of the Invention

The invention concerns electrical connectors.

It is more particularly concerned with connectors having the following functional characteristics:

- a large number of operating cycles (typically 5,000 to 50,000), which means that measures must be taken to prevent premature wear of parts rubbing together and to make the electrical contact members self-cleaning,
- large areas of contact, which means that the homologous moving parts of the connector must be able to provide satisfactory electrical contact over the full length of a relatively large insertion travel with relatively wide dimensional tolerances,
- moderate insertion and (end of travel) latching forces, as is usually the case with connectors where end of travel locking is provided by a mechanical member external to the connector proper: in this case the latching force must be limited (because it will be provided by the external member) and the connector must accommodate relatively wide dimensional tolerances (cf. the previous characteristic) because the mechanical precision of mating (mechanical approach of the mobile members) and that of the insertion travel depend on the external member rather than on the connector itself.

2. Description of the prior art

The cooperating members of a connector comprise at least one rigid conductor member which comes into mechanical and electrical contact with a flexible (i,e, elastically deformable) contact member relative to which it can move, These members are referred to hereinafter as the "rigid member" and the "flexible member" but in practise the rigid member is also called a "pin" or "male member" and the flexible member is then called a "socket" or "female member".

In a first type of connector shown in FIG. 1 the rigid member 1 extends in a longitudinal direction Δ and the flexible contact member(s) 2 are substantially parallel to the direction Δ. To make the electrical contact the rigid member 1 is moved in the longitudinal direction Δ, the effect of which is to push back the free end of the flexible member(s) in a transverse direction, i.e. in a direction substantially perpendicular to the direction Δ (as shown in dashed outline in the figure).

This connector structure has several advantages.

First of all, it is possible to obtain a long travel without difficulty because the deformation of the flexible members (transverse separation) depends only on the diameter of the rigid member and the travel in the longitudinal direction Δ may therefore be made longer without difficulty when designing the connector.

Secondly, because the length of the contact path (i.e. the locus of the successive points of contact over the length of the insertion travel) is equal to the travel of the connector, self-cleaning of the point of contact by rubbing is ensured without difficulty.

Finally, this type of connector requires only a moderate insertion and latching force: in FIG. 3 the curve I shows the F/d (insertion force/insertion length) characteristic of this type of connector. The curvilinear segment OA shows the force required to deform radially the flexible members 2; when the deformed position is reached there is a peak A whose amplitude may be limited by an appropriate choice of the cooperating shapes. Then, if insertion is continued (segment AB) the insertion force is substantially constant over all of the usable travel D.

However, this type of connector is subject to premature wear, precisely because the point of contact, which is practically fixed, travels a great distance along the rigid member because the length of the contact path is the same as the mechanical travel of the connector.

In a second type of connector shown diagrammatically in FIG. 2 and which is the type to which the invention relates the flexible contact member extends in a generally transverse direction substantially perpendicular (or strongly oblique) to the direction Δ in which the rigid contact member 1 extends. Connection is then achieved by relatively simple end bearing on the free end of the flexible member which bends progressively as the rigid member 1 is inserted.

Because the length of the contact path is much reduced as compared with the previous example, wear is much reduced, improving durability. On the other hand, self-cleaning is much reduced because the contact path is reduced.

However, the major drawback of this type of connector is that it requires a relatively high insertion force, especially at the end of travel: in FIG. 3 the curve II shows the respective F/d characteristic. Note that after a small force (segment OA') which is that required to reach the point A' at which satisfactory electrical contact is provided, on further insertion of the rigid member the force required increases very rapidly (segment A'B') because of the progressively increasing resistance due to the lever arm of the flexible member, which is increasingly strongly loaded. Also, the usable travel D' is much reduced as compared with the previous example.

These drawbacks (high insertion force and reduced travel) are particularly troublesome in the applications mentioned above where the two members of the connector are latched together by a member external to the connector proper: the maximum force $F_{max}$ permitted for latching the connector is then very quickly exceeded; also, the relatively short travel D' cannot compensate adequately for dimensional tolerances and therefore requires very careful construction of the external latching member because it is the dimensional accuracy of the latter which determines the functional quality of the connector.

One object of the present invention is to propose a connector which remedies these various drawbacks and provides long travel, low insertion force and high reliability (low wear and self-cleaning).

SUMMARY OF THE INVENTION

The invention consists in a connector comprising at least one elastically deformable lamellar flexible electrical contact member and at least one rounded rigid electric contact member which come into electrical and mechanical contact with each other through relative displacement of the rigid member towards the flexible member in a direction intersecting the general orientation of the flexible member which is thereby tensioned elastically, the free end of the flexible member having a curved area whose concave side faces towards the rigid member and whose radius of curvature is greater than the radius of the cross-section of the rigid member, said curved area being extended by an oppositely curved engagement area.

In its rest position the flexible member advantageously bears against shoulders of a connector body so as to close off an opening in the connector body receiving the rigid member.

The invention will now be described in more detail with reference to the appended drawings.

BRIEF DESCRIPTION OF THE DRAWINGS

FIG. 6 shows the insertion force/displacement characteristic of this connector.

FIG. 7 shows an embodiment in which the contacts are protected.

DETAILED DESCRIPTION OF THE INVENTION

Figure 1:
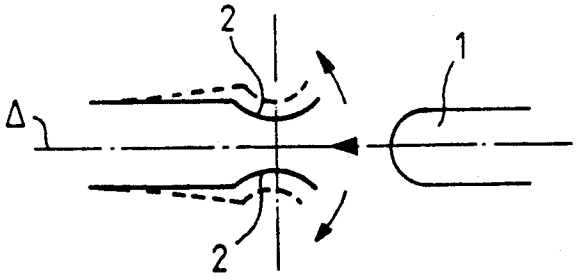
FIGS. 1 and 2 are diagrams showing two general connector types.
Figure 2:
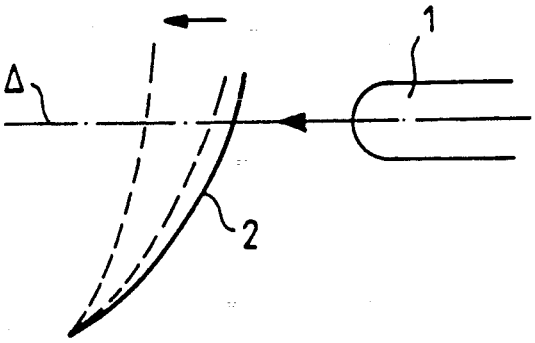
Figure 3:
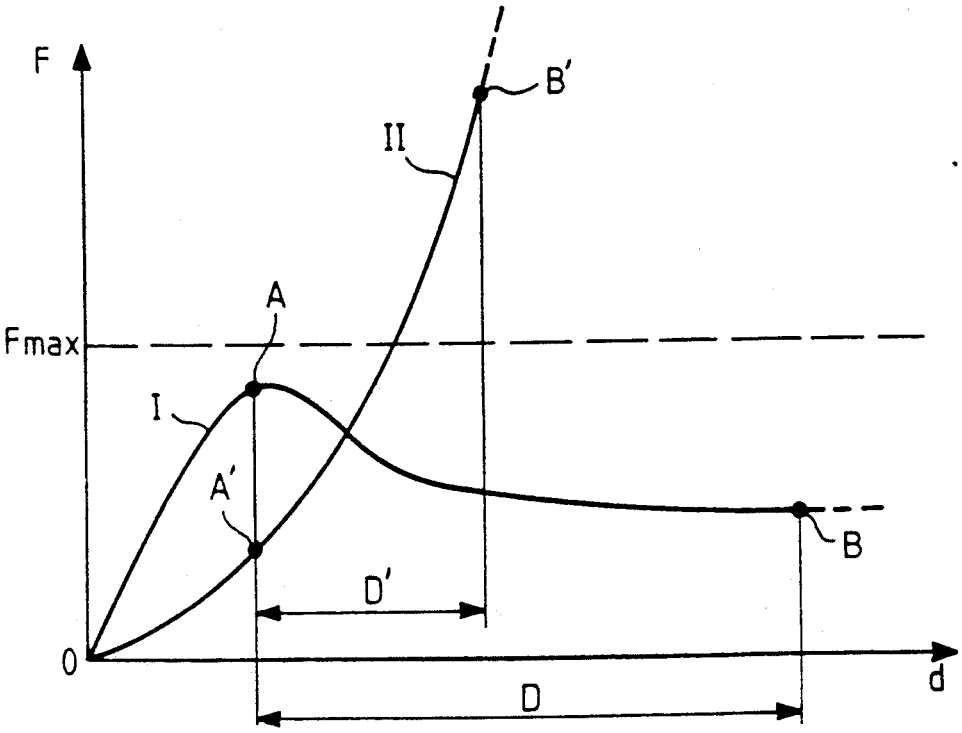
FIG. 3 shows the insertion force/relative displacement characteristic of the contact members of the connectors from FIGS. 1 and 2.
Figure 4:
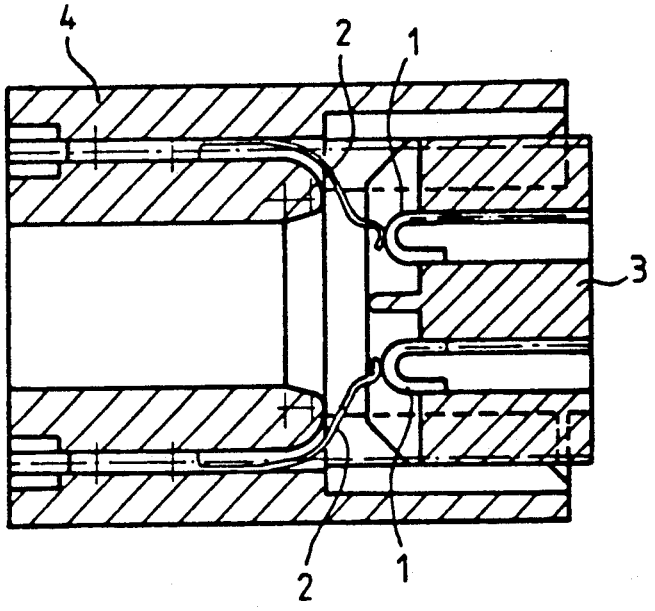
FIG. 4 is an overall view of a connector in accordance with the invention.

FIG. 4 shows in cross-section a connector of the invention which comprises rigid contact members 1, for example two parallel series of rigid contact members, carried by a plug body 3. The plug body 3 is inserted in a homologous housing in a socket body 4 carrying flexible contact members 2 cooperating with the rigid contact members 1.

FIG. 4 shows the contact members at the moment of engagement, i.e. the intermediate insertion position in which the members come into mechanical contact preceding full insertion which represents the mechanically latched position of the connector.

Figure 5:
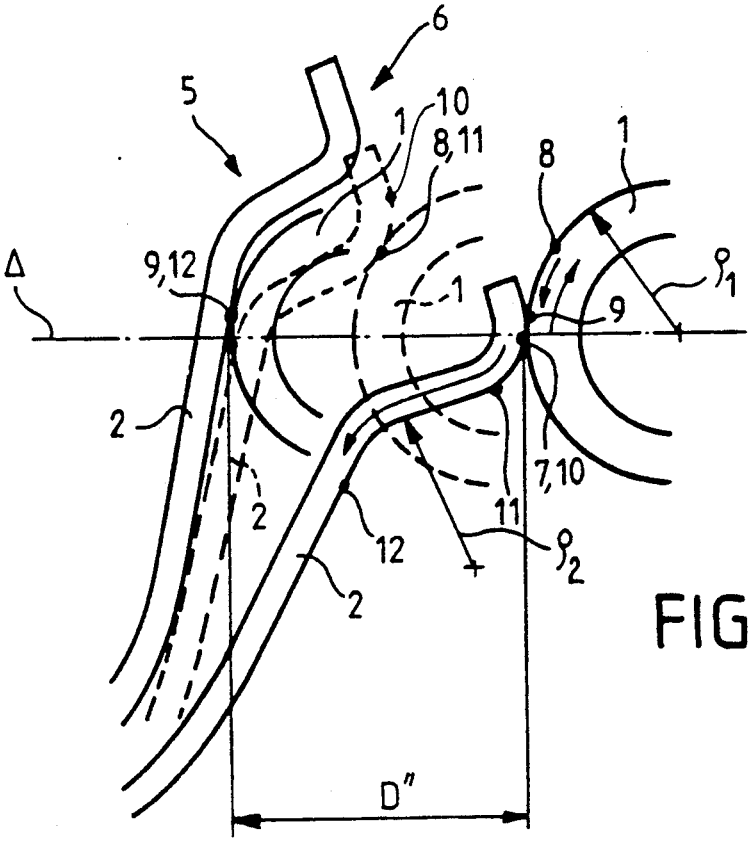
FIG. 5 shows to a larger scale and in various functional positions the cooperating surfaces of two members of the connector from FIG. 4.

FIG. 5 shows to a larger scale a rigid member 1 and a flexible member 2 in three different successive positions: the righthand position (in full outline) shows the engagement of the two members (the FIG. 4 position), the lefthand position, also in full outline, is the fully inserted position with the connector latched, and the center position (in dashed outline) is a specific intermediate position to be described later.

In cross-section the rigid member 1 has a substantially circular end of radius $\rho_1$.

The flexible member 2 is in the form of a flexible blade whose free end has a curved area 5 whose concave side faces towards the rigid member and whose radius of curvature $\rho_2$ is greater than that $\rho_1$ of the circular cross-section of the rigid member 1. This curved area 5 is followed by an oppositely curved engagement area 6 whose convex side therefore faces the rigid member.

Insertion occurs in two phases:

At the moment of engagement (the position shown on the right in the figure), contact is established between the point 7 of the rigid member 1 and a point 10 of the flexible member in the oppositely curved area. As the rigid member 1 continues to move in the direction Δ, the point of contact moves from 7 to 8 on the rigid member and from 10 to 11 on the flexible member. In the later position shown in dashed outline in FIG. 5 the point of contact has moved on the flexible member from the oppositely curved area 6 to the start of the curved area 5, i.e. substantially at the point of inflection where these two areas join together.

As the movement continues the point of contact moves from 8 to 9 on the fixed member and from 11 to 12 on the mobile member. In this second phase the point of contact has moved on the rigid member towards the initial engagement point 7 and the point of contact has moved on the flexible member over all of the curved area 5.

Thus over the travel D″ of the connector there has been a to-and-fro movement on the rigid member of the point of contact (from 7 to 8 and then from 8 to 9) whereas on the flexible member there has been a continuous movement (from 10 to 11 and then from 11 to 12) over a relatively long distance, i.e. the length of the curved area 5, despite a final displacement (the second phase above ) in the direction Δ which is relatively small. The to-and-fro movement results in excellent self-cleaning of the surfaces in contact.

From the static point of view, during this second phase, because the movement of the rigid member (in the direction Δ) is very small, that of the flexible member is also very small and the reaction force of the lever arm therefore increases only very slowly.

This property is clearly seen in the force/displacement characteristic (FIG. 6).

In this figure the total travel D″ is divided into a preliminary travel $d_1$ (between the engagement point 0 and the point A″ at which the force $F_1$ provides sufficient pressure for a good electrical contact) and a useful travel $d_2$ (between the point A″ and the complete insertion point B″ with the connector latched).

Between the points A″ and B″ the force to be applied varies (between $F_1$ and $F_2$) only in a relatively moderate fashion despite the very long travel; in one specific example a wide range of operation can be obtained with an initial travel $d_1=0.2$ mm and a useful travel $d_2=1.6$ mR, the force F varying typically only between $F_1=10$ N and $F_2=25$ N, yielding characteristics very much improved over conventional connectors.

FIG. 7 shows an embodiment in which the flexible member 2 abuts against two shoulders 13, 14 of the socket body 4 which protects the interior volume of the socket by shutting off the orifice 15 adapted to receive the rigid member 1; in this way a protected contact member is obtained very simply from cut-out members (the blade constituting the flexible contact member 2) although until now protected contact members were mainly obtained by means of retractable pistons, requiring machining that is much more costly and complex to implement.

There is claimed:

1. Connector comprising at least one elastically deformable lamellar flexible electrical contact member and at least one rounded rigid electrical contact member which come into electrical and mechanical contact with each other on relative displacement of said rigid member towards said flexible member along a path of insertion across which said flexible member is disposed, and flexed and tensioned elastically by said rigid member during said relative displacement and contact, said flexible member having a free end with a concave surface of contact facing towards said rigid member and into which an oppositely curved surface of contact transitions, said rigid member having a first radius of curvature and said concave contact surface of said flexible member having a second radius of curvature greater than said first radius of curvature of said rigid member, whereby a wiping contact of said rigid member with said concave contact surface of said free end occurs during said displacement which results in an increase in a distance on and along said concave surface of said wiping contact concurrently with flexing of said flexible member without increasing a rate of tensioning of said flexible member over at least a portion of said displacement.

2. Connector according to claim 1 wherein said rounded rigid electrical contact member has a substantially circular cross-section.

3. Connector according to claim 1, and further comprising:

a body of said connector generally enclosing said flexible member and presenting an opening through which said rigid member is insertable into contact with said flexible member;

said flexible member bearing against said connector body so as to close off said opening in said connector body prior to insertion therein of said rigid member.

4. In an electrical connector having at least one flexible electrical contact member with a free end disposed across a path of travel, and at least one rigid electrical contact member displaceable along said path of travel relative to said flexible member so as to wipingly contact said free end and flex and elastically tension said flexible member while making electrical and mechanical contact therewith, said flexible member remaining across said travel path throughout a complete displacement of said rigid contact member along said travel path relative to said flexible contact member, with a distance of wiping contact on said free end, and said tension, increasing with increasing of said flexing, the improvement comprising:

wiping contact means for minimizing said increasing tension and concurrently maximizing said wiping contact distance on said free end for said complete displacement, said wiping contact means comprising a curved contact surface of said free end along which said rigid member makes said wiping contact from an initial contact point on said curved surface to a following contact point on said curved surface such that a rate of said flexing to said displacement decreases concurrently with increasing of said wiping contact distance on said free end of said flexible contact member by said rigid contact member over at least a portion of said complete displacement.

5. The improvement as in claim 4, wherein said curved surface comprises:

a concavity having a surface along which said rigid member makes said wiping contact while traveling relatively deeper into said concavity to said following contact point.

6. The improvement as in claim 5, and said curved surface further comprising:

a convex surface portion of said free end from which said curved surface transitions into said concavity, said convex surface portion presenting said initial contact point.

7. The improvement as in claim 5, and further comprising:

said rigid member having a rounded contact portion with a first radius of curvature; and said concavity surface having a second radius of curvature greater than said first radius of curvature.

8. The improvement as in claim 7, and further comprising:

said electrical connector having a housing with an opening into said housing for reception of said rigid member;

said free end bearing against an inner surface of said housing and closing said opening prior to said reception of said rigid member.

* * * * *